US010845159B2

(12) United States Patent
Leroy et al.

(10) Patent No.: US 10,845,159 B2
(45) Date of Patent: Nov. 24, 2020

(54) FLEXIBLE COVER FOR A MISSILE CONTAINER

(71) Applicant: MBDA FRANCE, Le Plessis-Robinson (FR)

(72) Inventors: Bertrand Leroy, Le Plessis-Robinson (FR); Pascal Herquel, Le Plessis-Robinson (FR)

(73) Assignee: MBDA FRANCE, Le Plessis-Robinson (FR)

( * ) Notice: Subject to any disclaimer, the term of this patent is extended or adjusted under 35 U.S.C. 154(b) by 20 days.

(21) Appl. No.: 16/313,794

(22) PCT Filed: Jun. 20, 2017

(86) PCT No.: PCT/FR2017/000124
§ 371 (c)(1),
(2) Date: Dec. 27, 2018

(87) PCT Pub. No.: WO2018/002454
PCT Pub. Date: Jan. 4, 2018

(65) Prior Publication Data

US 2019/0323799 A1 Oct. 24, 2019

(30) Foreign Application Priority Data

Jul. 1, 2016 (FR) ..... 16 01043

(51) Int. Cl.
*F41F 3/04* (2006.01)
*F41F 3/077* (2006.01)

(52) U.S. Cl.
CPC ..... *F41F 3/077* (2013.01)

(58) Field of Classification Search
CPC ..... F41F 3/04
See application file for complete search history.

(56) References Cited

U.S. PATENT DOCUMENTS 4,498,368 A 2/1985 Doane
5,198,280 A * 3/1993 Harpell ..... F41H 1/02 428/102
5,677,029 A * 10/1997 Prevorsek ..... B32B 5/12 428/113

(Continued)

FOREIGN PATENT DOCUMENTS

FR 1 263 011 A 6/1961
KR 10-2012-0010589 A 2/2012

OTHER PUBLICATIONS

International Search Report dated Sep. 8, 2017, issued in corresponding International Application No. PCT/FR2017/000124, filed Jun. 20, 2017, 5 pages.

(Continued)

*Primary Examiner* — J. Woodrow Eldred
(74) *Attorney, Agent, or Firm* — Christensen O'Connor Johnson Kindness PLLC

(57) ABSTRACT

A flexible cover includes a main layer made of a first composite material that includes a first woven material and a first elastomer. The flexible cover also includes an auxiliary layer made of a second composite material that includes a second woven material and a second elastomer. The auxiliary layer is secured to a face of the main layer and includes petal-shaped regions that are separated from one another by weakening lines.

19 Claims, 3 Drawing Sheets

(56) References Cited

U.S. PATENT DOCUMENTS

| | | | | |
|---|---|---|---|---|
| 7,520,204 | B2 * | 4/2009 | Williams | F41F 3/077 220/200 |
| 7,954,412 | B2 * | 6/2011 | Jansson | F41F 3/077 89/1.817 |
| 8,418,593 | B2 * | 4/2013 | Truyman | F41F 3/042 89/1.8 |
| 2013/0125742 | A1 * | 5/2013 | Montagna | D04H 3/002 89/36.02 |

OTHER PUBLICATIONS

Written Opinion of the International Searching Authority dated Sep. 8, 2017, issued in corresponding International Application No. PCT/FR2017/000124, filed Jun. 20, 2017, 6 pages.

International Preliminary Report on Patentability dated Jan. 1, 2019, issued in corresponding International Application No. PCT/FR2017/000124, filed Jun. 20, 2017, 1 page.

* cited by examiner

FLEXIBLE COVER FOR A MISSILE CONTAINER

The present invention concerns a flexible cover for a missile container.

It is known that a container cover has for function to hermetically close the container in order to protect a missile installed in this container. The cover must be able to be opened in order to allow the missile or the propellant gases to pass during the firing of the latter.

Generally, the covers are divided into two categories:

- fragmentable covers, which are generally made of composite materials; and
- mechanisms with automatic openings, most generally metallic.

These solutions present different disadvantages. More specifically, the disadvantages of these solutions are:

- for the covers in composite materials:
  - the presence of debris projected at high speeds in various directions, these debris presenting a danger for the surrounding equipment, and even sometimes for the missile itself; and
  - in certain cases, an important force on the radome of the missile during the crossing of the cover in the departure phase: and
- for the mechanisms with automatic openings:
  - a more complex management of the safety in order to guarantee the opening;
  - a much more important mass; and
  - a high manufacturing cost.

The present invention has for object to overcome at least some of these disadvantages. More precisely, it has for object to overcome the problem of debris presenting a danger for the equipment, while guaranteeing a moderate effort on the radome of the missile, a low mass and a reduced manufacturing cost.

The present invention relates to a flexible cover, intended to be mounted on a missile container and able to be pushed open.

According to the invention, the flexible cover comprises:

- a layer referred to as the main layer, made of a composite material consisting of at least one woven and of at least one elastomer; and
- at least one layer referred to as the auxiliary layer, made of a composite material also consisting of at least one woven and of at least one elastomer, said auxiliary layer being secured to said composite layer on one of the faces of the latter, said auxiliary layer comprising petal-shaped regions that are separated from one another by lines referred to as weakening lines, said main layer and said at least one auxiliary layer forming a composite part.

Thus, thanks to the invention, the woven or wovens which are inserted into the elastomer to form the composite part ensure the mechanical resistance of the flexible cover which is, in addition, made hermetic thanks especially to the elastomer. In addition, said at least one auxiliary layer (comprising petal-shaped regions defining weakening lines) makes it possible to direct a precise cut of the flexible cover, along said weakening lines, which facilitates the opening. Furthermore, the part in composite material is very flexible, which allows the flexible cover to return, after an opening, to a position close to the position before the opening.

A flexible cover is thus obtained which makes it possible to avoid the generation of debris (presenting a danger for the equipment), while guaranteeing a moderate force on the radome of the missile, a low mass and a reduced manufacturing cost.

Advantageously, the flexible cover comprises:

- two auxiliary layers arranged on either side of the main layer. Preferably, the two auxiliary layers are arranged, with their petal-shaped regions, symmetrically, with respect to a substantially central plane of the main layer; and
- an antifriction coating on a face referred to as the inner face intended to be placed towards the inside of the container. This antifriction coating makes it possible especially to limit friction during the passing of the missile.

Furthermore, advantageously, said at least one auxiliary layer is linked to said main layer by stitches, which makes it possible to ensure a good hold of the petal-shaped regions. These stitches also participate in maintaining the flexible cover during the manufacturing process.

Advantageously:

- at least some of said stitches are arranged along weakening lines, which makes it possible to reinforce the maintaining along weakening lines;
- at least some of said stitches are arranged transversally to said weakening lines;
- stitches are provided over the entire surface of the petal-shaped regions;
- the petal-shaped regions are arranged so that the weakening lines are oriented radially relative to the centre of the flexible cover.

In a preferred embodiment:

- the composite material forming said at least one auxiliary layer is identical to the composite material forming the main layer. In the context of the present invention, the composite material forming the auxiliary layer can also be different from the composite material forming the main layer;
- the weakening lines are filled with elastomer.

The present invention also concerns a missile container that comprises at least one flexible cover such as described hereinabove.

The present invention furthermore concerns a weapons system that comprises at least one such missile container.

The appended figures will allow to properly understand how the invention can be achieved. In these figures, identical references designate similar elements.

Figure 1:
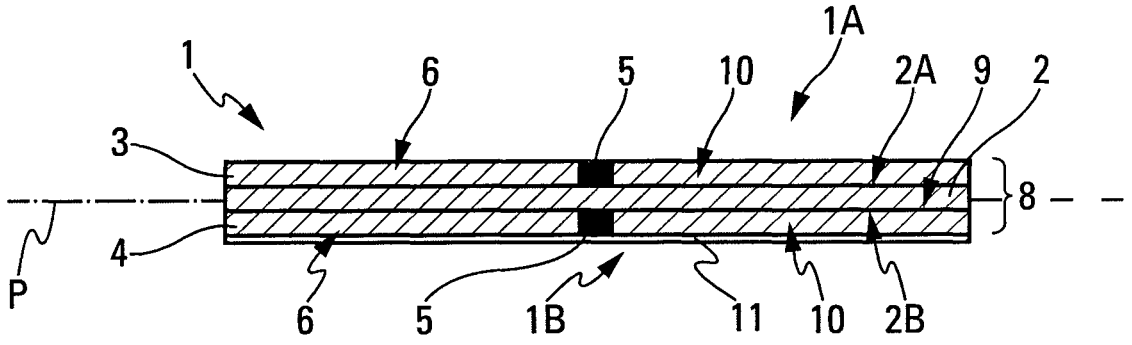
FIG. 1 is a schematic transversal cross-section view of a preferred embodiment of a flexible cover according to the invention.

The flexible cover 1 illustrating the invention and shown in a schematic way in FIG. 1 is intended to be mounted on a missile container (not represented).

This missile container is part of a weapons system (also not represented).

The flexible cover 1 has for function to hermetically close the container in order to protect a missile installed in the container. The flexible cover must be able to open in order to allow the missile or the propellant gases to pass during a firing of the latter.

To do this, the flexible cover 1 is configured to be pushed open. In the context of the present invention, this push can be generated during a firing by a contact of the flexible cover by the missile, or by an internal overpressure generated by dedicated means or by propellant gases of the missile.

Figure 2:
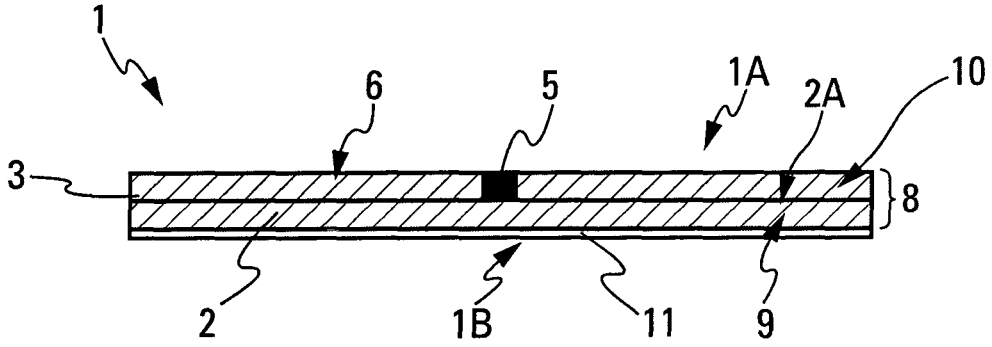
FIG. 2 is a schematic transversal cross-section view of another embodiment of a flexible cover according to the invention.

According to the invention, the flexible cover 1 comprises, as represented in FIGS. 1 and 2:

- at least one composite layer (or skin), referred to as the main layer 2. This main layer 2 is formed completely (over its entire surface) of a composite material 9 consisting of at least one woven and of at least one elastomer; and
- at least one additional composite layer (or skin), referred to as the auxiliary layer 3, 4. Each of said auxiliary layers 3 and 4 is made of a composite material 10 consisting of at least one woven and of at least one elastomer. Each auxiliary layer 3, 4 is linked (or secured or joined) to said composite layer 2 on one of the faces 2A, 2B of the latter.

In addition, each auxiliary layer 3, 4 comprises a plurality of petal-shaped regions 6 (made of composite material 10), for example of triangular shape, which are separated from one another by separation lines, referred to as weakening lines 5.

These weakening lines 5, devoid of woven, are filled with elastomer (of the composite material 10), as represented in black in FIGS. 1 and 2.

Said main layer 2 and said at least one auxiliary layer 3, 4 thus form a monobloc composite part 8. In a preferred embodiment, the composite material 10 forming the auxiliary layer or layers 3, 4 is identical to the composite material 9 forming the main layer 2.

The composite layer 2 and the auxiliary layer or layers 3, 4 thus form a flexible composite part 8 that, thanks to its flexibility, allows the flexible cover 1 to return, after an opening, to a position which is close to its position before the opening, as mentioned hereinbelow.

The arrangement of the auxiliary layer or layers 3, 4 with petal-shaped regions 6 makes it possible to direct a precise cut of the composite material (elastomer/woven), along the weakening lines 5 formed between these regions 6.

Furthermore, the woven or wovens, which are inserted into the elastomer in order to form the composite material 9, 10 provide the mechanical strength of the flexible cover 1. This woven or these wovens are made, in particular, from carbon fibres or glass fibres, or textile fibres (polyester, polyamide, etc.).

The composite material 9, 10 also makes it possible, thanks to the elastomer, to make the flexible cover 1 hermetic. The elastomer can be made from different materials. Preferably, this elastomer is of the butyl, neoprene, silicone, etc. type.

In a first preferred embodiment, represented in FIG. 1, the flexible cover 1 comprises two auxiliary layers 3 and 4 which are arranged on either side of the main layer 2, respectively on the faces 2A and 2B of the latter.

The two auxiliary layers 3, 4 are arranged, with their petal-shaped regions 6, symmetrically, with respect to a substantially central plane P of the main layer 2 with a generally planar shape. Thus, the weakening regions are located at the same position on either side of the main layer 2.

Moreover, in a second simplified embodiment, represented in FIG. 2, a single auxiliary layer 3 (woven/elastomer) is provided on the outer face 2A of the main layer 2 (woven/elastomer), i.e. on the face 1A that will be directed towards the outside of the container in the mounted position of the flexible cover 1. This makes it possible to limit the forces required for opening.

FIG. 1 also represents the inner faces 1B and 2B of the flexible cover 1 and of the main layer 2.

Moreover, as represented in FIGS. 1 and 2, the flexible cover 1 comprises, in addition, an antifriction coating 11 on the inner face 1B, which is therefore intended to be placed towards the inside of the container.

This antifriction coating 11 makes it possible, especially, to limit the friction during the passing of the missile through the flexible cover 1.

The antifriction coating 11 is achieved for example from a metallic material, which makes it possible, in addition to reducing the coefficient of friction, to provide an electrical continuity.

The regions 6 therefore make it possible to create the weakening lines 5, which facilitates the tearing of the composite material 9 (woven/elastomer) of the main layer 2 along precise directions. Preferably, the weakening lines 5 are arranged radially in relation to the centre 12 of the flexible cover 1, as represented in FIGS. 3 to 5.

Figure 3:
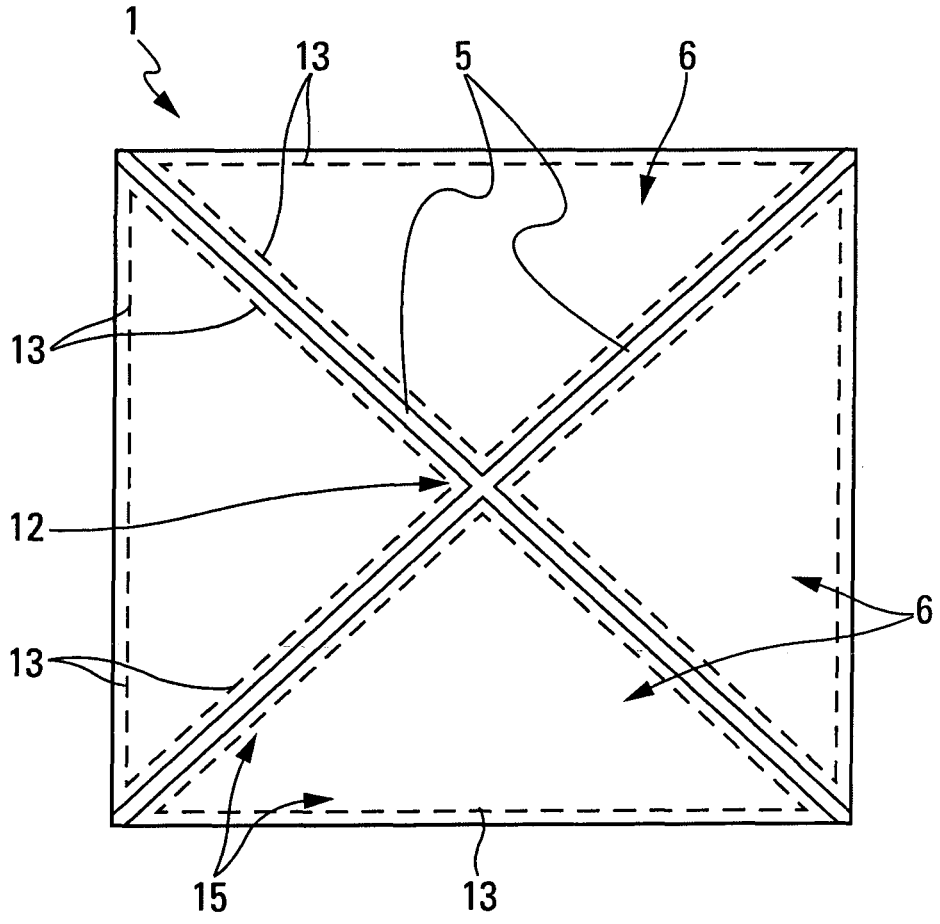
FIGS. 3 and 4 are two schematic plan views, illustrating different embodiments of weakening lines of a flexible cover.
Figure 4:
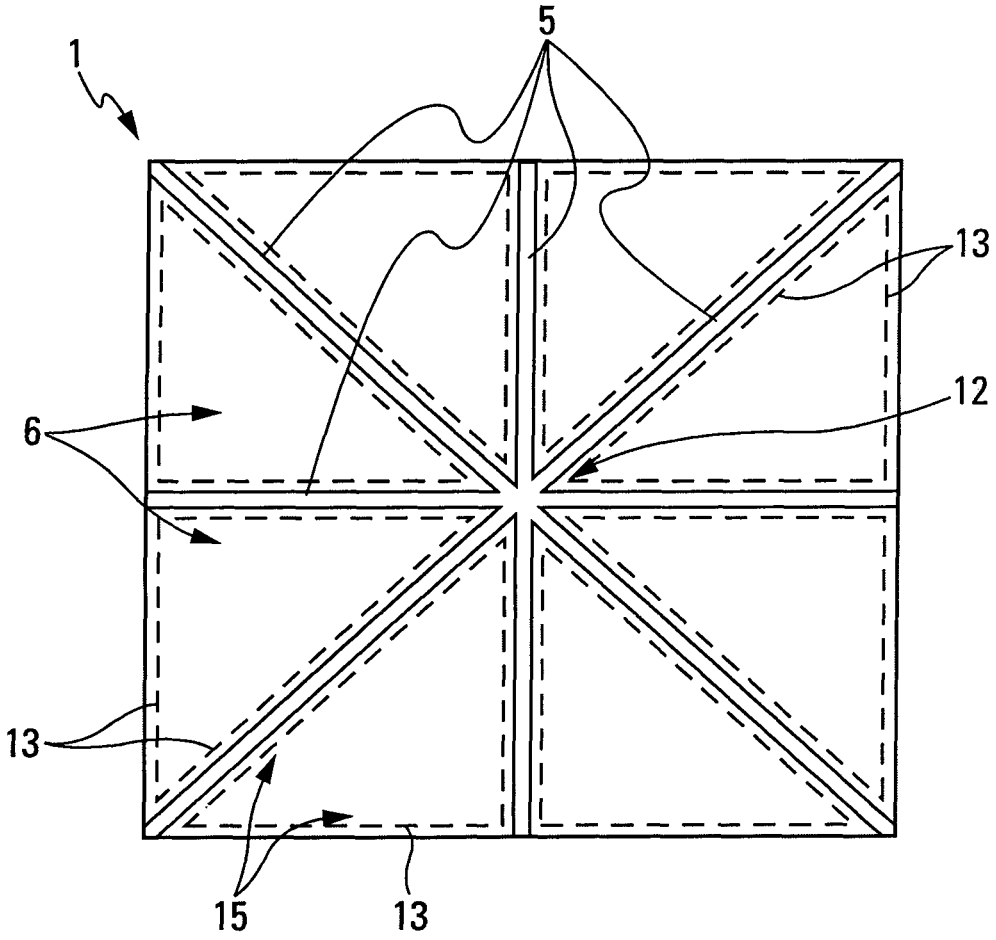
Figure 5:
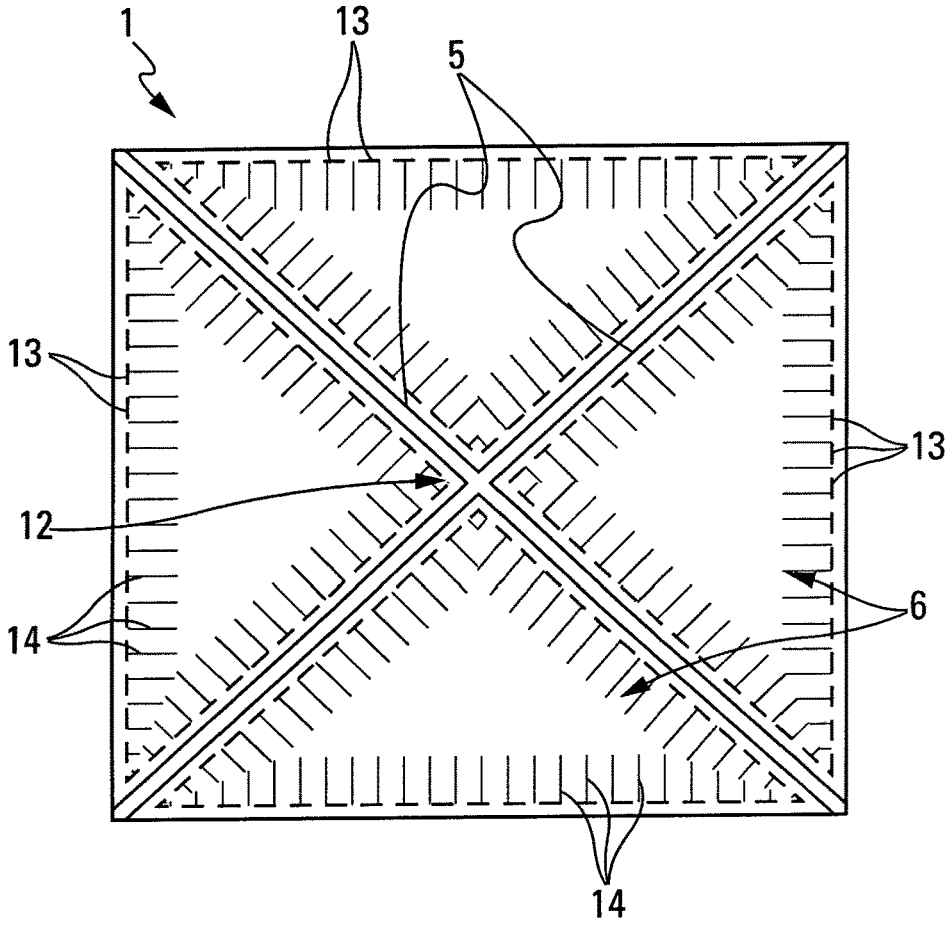
FIG. 5 is a plan view similar to that of FIG. 3 with a particular arrangement mode of stitches.

Depending on the size of the missile and of the cover, the weakening lines 5 are more or less numerous, for example two lines oriented according to the diagonals as in the examples of FIGS. 3 and 5 or four lines oriented according to the diagonals and the side bisectors as represented in the example of FIG. 4.

Other shapes can of course be provided for the weakening lines in the context of the present invention.

Moreover, in a preferred embodiment, especially in order to ensure good resistance of the petals, each auxiliary layer 3, 4 is linked to the main layer 2 by stitches 13 and 14 (FIGS. 3 to 5). These stitches 13 and 14, via the additional maintaining that they provide, provide assistance in the tearing of the main layer 2 at the level of the weakening lines 5. These stitches 13 and 14 also participate in the maintaining of the woven of the auxiliary layers 3 and 4 on the main layer 2, during the manufacturing process of the flexible cover. They are usually made using threads, for example made of polyamide, which correspond, more preferably but not exclusively, to the threads of the wovens used to form the composite materials 9 and 10.

Preferably, certain stitches 13 are arranged in the regions 6, parallel to the weakening lines 5, along seam lines 15, which makes it possible to facilitate the tearing along the weakening lines 5.

Furthermore, in a particular embodiment, represented in FIG. 5, certain stitches 14 are arranged transversally to said weakening lines 5.

Moreover, in a particular embodiment (not represented), stitches can be provided over the entire surface of the petal-shaped regions 6. The distribution of these stitches can then have different forms.

The flexible cover 1, such as described hereinabove, presents especially the following advantages:

- a facilitated opening and re-closing;
- a reduced manufacturing cost;
- a reduced mass;
- an absence of generation of debris.

For the purposes of illustration, the flexible cover 1 can be designed for containers of variable dimensions, and in particular:

- for a cylindrical container, with a diameter between 100 mm (millimetres) and 1000 mm; or for a parallelepiped container, with a section between 100×100 mm and 1000×1000 mm.

In addition, the flexible cover 1 is designed, preferably, to withstand pressures comprised between 1 and 5 bars, and to start opening at 5 bars.

A method for manufacturing a flexible cover 1 such as described hereinabove is now generally presented. This method for manufacturing comprises, especially, the following steps:

a step of putting in place the woven of the main layer 2 from impregnated threads;

a step of putting in place the woven of the auxiliary layer or layers 3, 4, with a fixation with stitches 13, 14 on the woven of the main layer 2; and a step of assembling different layers 2, 3 and 4 of the flexible cover by vulcanisation.

The operation of the flexible cover 1 is also specified. During the generation of a push to open the flexible cover 1 closing the container, for the purposes of a firing of a missile installed in the container, starting from a certain pressure (for example 5 bars), the flexible cover 1 (and more particularly the composite part 8 and where applicable also the antifriction coating 11) tears according to the weakening lines 5, and the flexible petals 6 thus released are curved outwards to open the flexible cover 1 and release the passage for the missile. After the exit of the missile from the container, the flexible petals 6 return, thanks to their flexibility, to an initial position so that the flexible cover 1 is close to its position before the opening so as to allow for the closing of the door of the cell.

Figure 6:
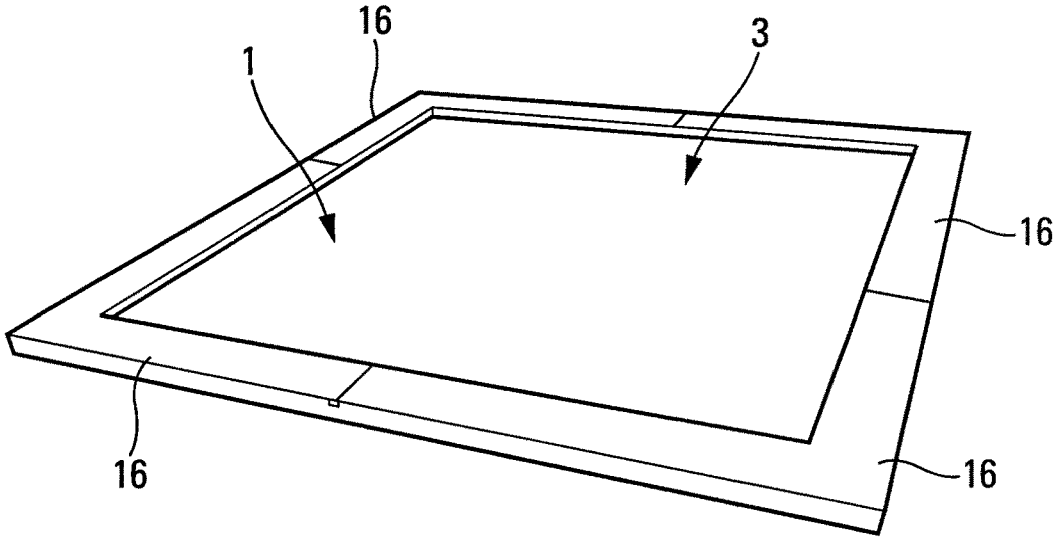
FIG. 6 is a schematic and perspective view of means for fixing a flexible cover.

As represented in FIG. 6, several elements 16 (or flanges), for example made of stainless steel, in particular four elements 16 in the form of a bracket, make it possible to clamp the flexible cover 1 on the container (not represented).

A possible application of the invention concerns a container of a missile launcher, which is on board a ship. Such a container generally comprises a series of cells, each cell being intended to receive a missile placed in its container. The upper portion of a cell opens onto the deck of the ship and is closed, outside of the launching phases, by a door. The lower portion of a cell comprises a communication opening that opens into a chamber intended to receive the gases emitted during the launching of a missile. The upper and lower portions of each container are hermetically sealed, by a lid provided with a top flexible cover, such as the flexible cover 1 specified hereinabove, and by a bottom provided with, for example, also a bottom flexible cover such as the flexible cover 1. The interior volume of the container is, in general, filled with an inert gas that is over-pressurised with respect to the atmosphere. During the launch of the missile, a door of the cell is opened, and the missile is fired. The propellant gases then importantly increase the temperature and the pressure inside the container, which perforates the top flexible cover of the container (and where applicable opens the bottom flexible cover). After the firing, the flexible cover or covers return approximately to their initial position and the door of the cell is closed.

The invention claimed is:

1. A flexible cover, configured to be mounted on a missile container and to be pushed open, the flexible cover having a first side opposite a second side, the first side facing an interior portion of the missile container when mounted thereon, the flexible cover comprising:

a main layer made of a first composite material comprising a first woven material and a first elastomer;

a first auxiliary layer made of a second composite material comprising a second woven material and a second elastomer, the first auxiliary layer being secured to the main layer, on a first face of the latter, the first auxiliary layer comprising petal-shaped regions that are separated from one another by weakening lines, wherein the first auxiliary layer is coupled to the main layer by stitches; and an antifriction coating disposed on the first side of the flexible cover.

2. The flexible cover according to claim 1, further comprising a second auxiliary layer arranged on a second face of the main layer opposite the first face, the second auxiliary layer comprising petal-shaped regions that are separated from one another by weakening lines, wherein the second auxiliary layer is coupled to the main layer by stitches.

3. The flexible cover according to claim 2, wherein the petal-shaped regions of the first and second auxiliary layers are arranged symmetrically with respect to a plane (P) central to a thickness of the main layer.

4. The flexible cover according to claim 1, wherein at least some of the stitches are arranged parallel to at least one of the weakening lines.

5. The flexible cover according to claim 1, wherein at least some of the stitches are arranged transversally to at least one of the weakening lines.

6. The flexible cover according to claim 1, wherein stitches are provided parallel to each weakening line.

7. The flexible cover according to claim 1, wherein the weakening lines extend radially from a center portion of the flexible cover.

8. The flexible cover according to claim 1, wherein at least one of: (1) the first woven material is the same as the second woven material, and (2) the first elastomer is the same as the second elastomer.

9. The flexible cover according to claim 1, wherein the weakening lines are filled with elastomer.

10. A missile container, comprising at least one flexible cover according to claim 1.

11. A weapons system, comprising at least one missile container according to claim 10.

12. The flexible cover according to claim 1, wherein the first woven material is the same as the second woven material.

13. The flexible cover according to claim 1, wherein the first elastomer is the same as the second elastomer.

14. The flexible cover according to claim 8, further comprising a second auxiliary layer arranged on a second face of the main layer opposite the first face, the second auxiliary layer comprising petal-shaped regions that are separated from one another by weakening lines, wherein the second auxiliary layer is coupled to the main layer by stitches.

15. The flexible cover according to claim 14, wherein the petal-shaped regions of the first and second auxiliary layers are arranged symmetrically with respect to a plane (P) central to a thickness of the main layer.

16. The flexible cover according to claim 8, wherein at least some of the stitches are arranged parallel to at least one of the weakening lines.

17. The flexible cover according to claim 8, wherein at least some of the stitches are arranged transversally to at least one of the weakening lines.

18. The flexible cover according to claim 8, wherein stitches are provided parallel to each weakening line.

19. The flexible cover according to claim 8, wherein the weakening lines extend radially from a center portion of the flexible cover.

* * * * *